US011896093B2

(12) United States Patent
Loetscher

(10) Patent No.: US 11,896,093 B2
(45) Date of Patent: Feb. 13, 2024

(54) WRISTLET CLASP WITH LENGTH ADJUSTMENT

(71) Applicant: OMEGA SA, Bienne (CH)

(72) Inventor: Philippe Loetscher, Evilard (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 17/836,531

(22) Filed: Jun. 9, 2022

(65) Prior Publication Data

US 2023/0109520 A1 Apr. 6, 2023

(30) Foreign Application Priority Data

Oct. 1, 2021 (EP) ..... 21200541

(51) Int. Cl.
*A44C 5/24* (2006.01)

(52) U.S. Cl.
CPC ..... *A44C 5/246* (2013.01)

(58) Field of Classification Search
CPC ..... A44C 5/246; A44C 5/24; Y10T 24/2155; Y10T 24/4782
See application file for complete search history.

(56) References Cited

U.S. PATENT DOCUMENTS 1,985,835 A * 12/1934 Prestinari ..... A44C 5/246 24/71 J
2,542,358 A * 2/1951 Ritter ..... A44C 5/246 D11/87
2,596,186 A * 5/1952 Paul ..... A44C 5/246 24/71 J
3,696,469 A 10/1972 Kalinsky
5,485,659 A * 1/1996 Kashikie ..... A44C 5/246 24/71 J
5,749,128 A * 5/1998 Cuche ..... A44C 5/246 24/70 J
6,944,916 B2 * 9/2005 Kawagoe ..... A44C 5/246 24/70 J (Continued)

FOREIGN PATENT DOCUMENTS

EP 0350785 B1 1/1993
EP 2740381 A1 6/2014

(Continued)

OTHER PUBLICATIONS

Search Report for EP 21 20 0541 dated Mar. 11, 2022.

*Primary Examiner* — Robert Sandy
*Assistant Examiner* — Rowland Do
(74) *Attorney, Agent, or Firm* — Sughrue Mion, PLLC

(57) ABSTRACT

A wristlet clasp (100), of the folding buckle type, including first and second hinged blades (1, 2) between a closed wearing position and at least one open position, the first blade carrying a member for fastening a first wristlet strand, the second lower blade being connected to a loop (3) at its second end, the loop defining a passage for a second wristlet strand and carrying a stud (31) intended to be inserted into an adapted hole in the wristlet strand to define a point for anchoring the latter to the clasp. A locking member (12) holds the first and second blades in their closed position. A carriage (4) is connected to the second end of the second blade and slides in the loop switching from first and second indexed positions to define at least two predefined positions associated with a predefined useful length of the wristlet.

12 Claims, 3 Drawing Sheets

(56) References Cited

U.S. PATENT DOCUMENTS

| | | | | |
|---|---|---|---|---|
| 8,001,658 | B2 * | 8/2011 | Christian | A44C 5/246 24/71 J |
| 9,149,093 | B2 * | 10/2015 | Leger | A44C 5/246 |
| 9,314,073 | B2 * | 4/2016 | Kaltenrieder | A44C 5/246 |
| 2013/0286797 | A1 * | 10/2013 | Leger | G04B 37/14 24/316 |
| 2014/0150495 | A1 * | 6/2014 | Kaltenrieder | A44C 5/246 63/3.2 |
| 2015/0366303 | A1 * | 12/2015 | Pier | A44C 5/246 24/71 J |
| 2020/0187605 | A1 * | 6/2020 | Catanese | A44C 5/246 |

FOREIGN PATENT DOCUMENTS

| | | | | |
|---|---|---|---|---|
| EP | 2767184 | A1 | 8/2014 | |
| WO | WO-2019166671 | A1 * | 9/2019 | A44C 5/246 |

* cited by examiner

WRISTLET CLASP WITH LENGTH ADJUSTMENT

CROSS REFERENCE TO RELATED APPLICATION

The present application is based on, and claims priority from the prior European Patent Application No. 21200541.7, filed on Oct. 1, 2021, the entire contents of which are incorporated herein by reference.

TECHNICAL FIELD

The present invention relates to a wristlet clasp with a device for adjusting the useful length of the wristlet.

The present invention also relates to a wristwatch provided with such a clasp.

BACKGROUND

The problem relating to the need to provide a device for adjusting the useful length of a wristlet is well known.

On the one hand, in the case of wristlets made up of links, it is possible for the wrist of the wearer to have a circumference whose value is located between two configurations of the wristlet differing from each other by a single link. Also, it is useful to provide a device for adjusting the useful length of the wristlet allowing finer adjustment of the length of the wristlet than removing or adding a link.

On the other hand, it is also known that the value of the circumference of the wrist varies according to the seasons, a maximum value being generally reached in summer and a minimum value being reached in winter. It is here again preferable to provide a device for finely adjusting the useful length of the wristlet allowing the wearer of the wristlet to adjust this length to improve the comfort of the wristlet when worn.

By way of example, patent application EP 09131060 A1 describes a clasp of the folding buckle type including a cover having a series of pairs of holes intended to house the ends of a strip for fastening a wristlet. Two pairs of adjacent holes are spaced apart by a distance defining an adjustment pitch of the useful length of the wristlet, to address the problems mentioned above.

However, such a device for adjusting the length of the wristlet is unattractive given that the adjustment holes are visible on the sides of the cover. Furthermore, the adjustment operation of such a clasp requires a certain dexterity because it requires introducing a pointed tool into the holes to compress the wristlet fastening strip, which risks leading to damage at the cover in case of clumsiness of the person making the adjustment.

To avoid such a situation, alternative devices have already been disclosed, such as for example in patent EP 0350785 B1 which describes a clasp similar to the previous one but comprising as an alternative a device for adjusting the useful length of the wristlet which can be handled without tools. Indeed, the clasp described in this patent is of the folding buckle type including two blades hinged together by means of a rod passing through both of them, each of the blades carrying at its free end a member for fastening to a wristlet. A first blade carries a hook intended to engage into a hole provided in the second blade to cooperate with a trigger allowing to lock the hook and therefore the clasp in a closed state. The second blade comprises two parts capable of sliding relative to each other within a certain predefined range, defining a pitch for adjusting the useful length of the wristlet. A first of its two parts carries the hinge connecting it to the first blade while the second part carries the locking trigger. The hole wherein the hook engages to lock the clasp has a length, in the longitudinal direction of the wristlet, corresponding to the sliding range between the two parts of the second blade. The trigger has a central part defining two locations for the hook, along the longitudinal direction of the wristlet, corresponding to two different useful lengths of the wristlet. A control member comprising in particular a push-piece allows to actuate the trigger to release the hook and open the clasp.

It may be pointed out that a disadvantage which results from this structure is the loss of adjustment of the length of the wristlet each time the clasp is opened. Therefore, the wearer of the wristlet must ensure at each closing of his clasp that the hook is inserted on the side of the central portion of the trigger corresponding to the desired length for the wristlet.

Adjusting devices including a specific locking member have also been proposed, as an alternative, to avoid this type of disadvantage.

SUMMARY OF THE INVENTION

A main object of the present invention is to overcome the disadvantages of clasps known from the prior art, by proposing a wristlet clasp comprising a device for adjusting the useful length of the wristlet of simple structure, preferably proposing stable adjustment, including when the clasp is open, and easy to handle.

To this end, the present invention relates more particularly to a wristlet clasp comprising first and second blades hinged relative to each other, by a first of their respective ends, between a closed wearing position and at least one open position, said first blade carrying a member for fastening a first wristlet strand, said second lower blade being connected to a loop at its second end, the loop defining a passage for a second wristlet strand and carrying a stud intended to be inserted into an adapted hole in the wristlet strand to define a point for anchoring the latter to the clasp, the clasp further including at least one locking member for holding said first and second blades in their closed position.

According to the invention, a carriage connected to the second end of the second blade, said carriage being arranged to slide in the loop and able to switch from a first indexed position to a second indexed position to define at least two predefined positions associated with a predefined useful length of the wristlet.

In accordance with other advantageous variants of the invention:

- said loop comprises two guide grooves disposed opposite each other and wherein the carriage slides in the direction of the length of the clasp;
- the loop comprises indexing means defining the first and second indexed positions;
- the indexing means comprise at least two notches disposed on at least one of the guide grooves;
- the loop comprises a control member arranged to allow the movement of the carriage from one position to another;
- the control member is in the form of a push-piece arranged on the carriage, the push-piece comprising a lug arranged to cooperate with the indexing means;
- the push-piece is arranged to translate in a direction perpendicular to the direction of the length of the clasp;
- the clasp comprises return means arranged to maintain the control member under stress;

the carriage comprises means for limiting the stroke of the latter;

the means for limiting the stroke of the carriage comprise a pin integral with the loop and arranged to cooperate with an oblong hole of the carriage;

the ends of the oblong hole define two indexed positions of the carriage.

The invention also relates to a wristwatch including a wristlet provided with a clasp in accordance with the invention.

BRIEF DESCRIPTION OF THE DRAWINGS

Other features and advantages of the present invention will appear more clearly upon reading the detailed description of a preferred embodiment which follows, made with reference to the appended drawings given by way of non-limiting examples and wherein.

EMBODIMENT(S) OF THE INVENTION

The clasp illustrated without limitation in the figures corresponds to a preferred embodiment of the present invention. More specifically, the clasp 100 is of the folding buckle type and is intended to close a timepiece wristlet.

Figure 1:
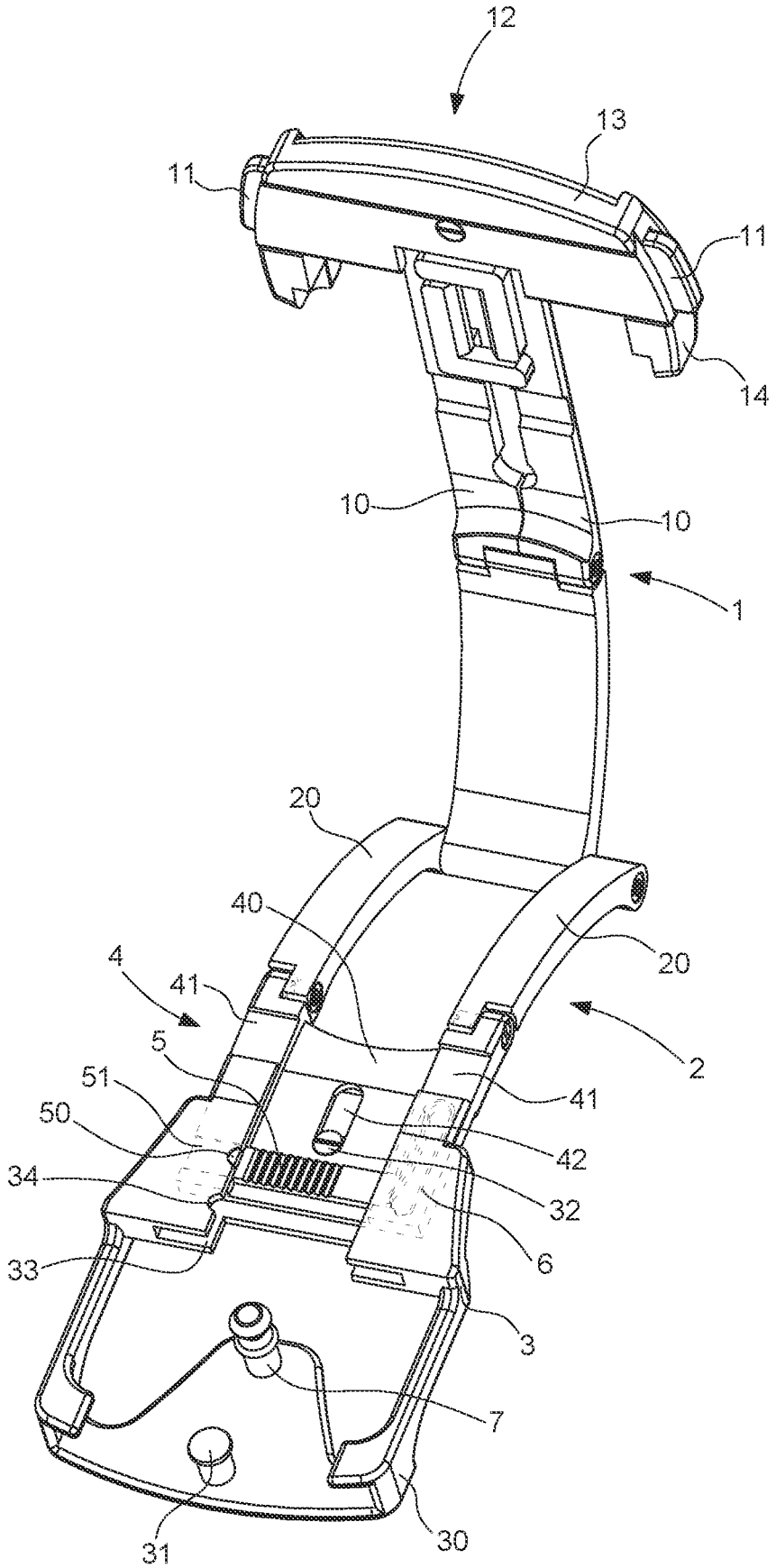
FIG. 1 shows a perspective view of a clasp in accordance with the invention.

As shown more particularly in FIGS. 1 and 2, the clasp 100 includes a first blade 1 hinged on a second blade. Each of the blades has an elongated shape in the longitudinal direction of the wristlet and slightly curved to better match the shape of the wearer's wrist.

The first blade 1 comprises two uprights 10 arranged in contact with each other at one of their ends and, each having a cutout 11 such that they are not in contact with each other over the greater part of their length.

Each of the uprights 10 carries an extension 11, close to its other end, extending in a direction perpendicular to the longitudinal direction of the wristlet, to form a push-piece defining a control member allowing to unlock the clasp, as emerges from FIG. 1.

Moreover, the free end of the first blade 1 carries means for holding the wristlet intended to be associated with the clasp 100.

The holding means comprise a cover 12 having an upper wall 13 carrying side walls 14. The side walls 14 are provided with two holes 8 allowing to house one end of a strip for fastening a wristlet strand, in a conventional manner.

The second blade 2 comprises two arms 20 connected on the one hand to the first blade 1, and on the other hand to a loop 3 via a carriage 4. The loop 3 comprises bent portions 30 for the passage of a wristlet strand, offset from the general direction of the arms 20 to define a passage for the wristlet strand.

The loop 3 has a first stud 7 and a second stud 31, both intended to be engaged in a different hole in the wristlet to define a first and a second anchor point for the wristlet strand to the clasp 100 and thus keep it well aligned relative to the clasp.

Advantageously, the loop 3 disposed at the end of the second blade 2 carries a device for adjusting the useful length of the wristlet intended to be associated with the clasp.

The device for adjusting the useful length of the wristlet comprises in particular the carriage 4 which is provided with a base 40 of rectangular shape and two uprights 41, and which is arranged to move in the loop 3 in the direction of the length of the clasp. The uprights 41 are arranged to slide in corresponding guide grooves 33 provided on the side edges of the loop 3.

According to the invention, the carriage 4 comprises an oblong hole 42 formed on the base 40, the oblong hole 42 cooperating with a pin 32 integral with the loop 3. Thus, the pin 32 passes through the oblong hole when the carriage 4 is mounted in the loop 3, the uprights 41 being housed in the grooves 33. The oblong hole 42 and the pin 32 allow to define the length of the stroke of the carriage 4 relative to the loop 3, the ends of the oblong hole 42 thus defining the extreme positions of the carriage 4.

Figure 2A:
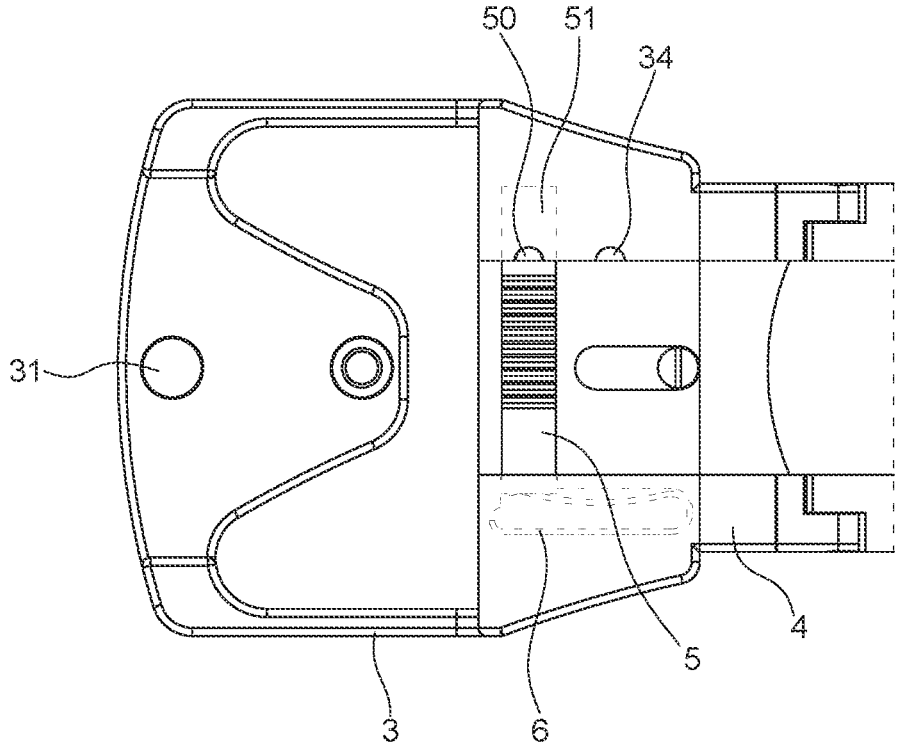
FIGS. 2*a* and 2*b* show a top view of part of a clasp in accordance with the invention, with the push-piece respectively in the rest position and in the retracted position.
Figure 2B:
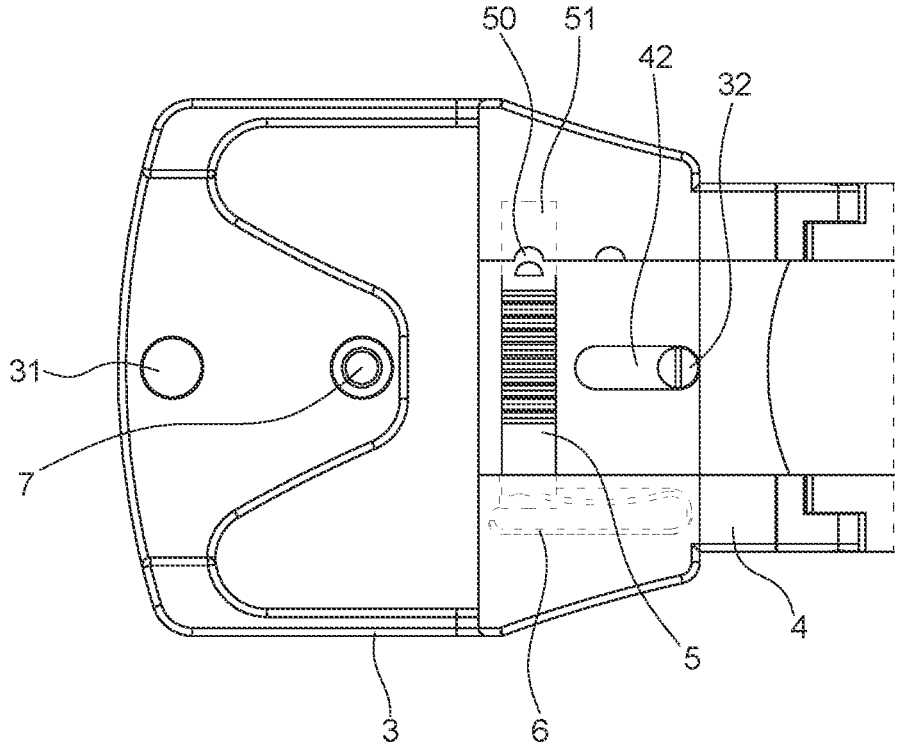

As illustrated in FIGS. 2*a* and 2*b*, the loop 3 comprises indexing means defining at least first and second indexed positions, these positions allowing to adjust the comfort of the clasp. Advantageously, the indexing means comprise at least two notches 34 disposed on at least one of the guide grooves 33 to form said at least first and second indexed positions.

The loop 3 also comprises a control member arranged to allow the movement of the carriage from one position to another, the control member being in the form of a push-piece 5 arranged on the carriage 3 and moving with the latter. As can be seen in FIGS. 2*a* and 2*b*, the push-piece 5 comprises on its upper face a lug 50 arranged to cooperate with the notches 34 of the groove 33 so as to lock the chosen position, namely the first or the second position in the example shown. The push-piece 5 extends over a large part of the width of the carriage 4 and has a flat portion 51 directly after the lug 50 and being housed in one of the uprights 41 of the carriage 4. Such an arrangement allows to prevent the push-piece from being dislodged from the carriage 4 during its handling.

Obviously, a higher number of positions for adjusting the length of the clasp, for example three, four or five, is entirely possible for the person skilled in the art who only has to increase the number of notches 34.

The push-piece 5 is arranged to translate in a direction perpendicular to the direction of the length of the clasp, that is to say in a direction perpendicular to the movement of the carriage 4, and has on its upper face a textured portion to facilitate the gripping the push-piece 5.

In order to hold the push-piece 5 in its locked position, the carriage 4 comprises return means, in the form of a leaf spring 6, arranged to maintain the control member under stress. Thus, to move the push-piece 5, the user must slide the latter to constrain the leaf spring 6 and dislodge the lug 50 from the notch 34 wherein it is located.

Figure 3:
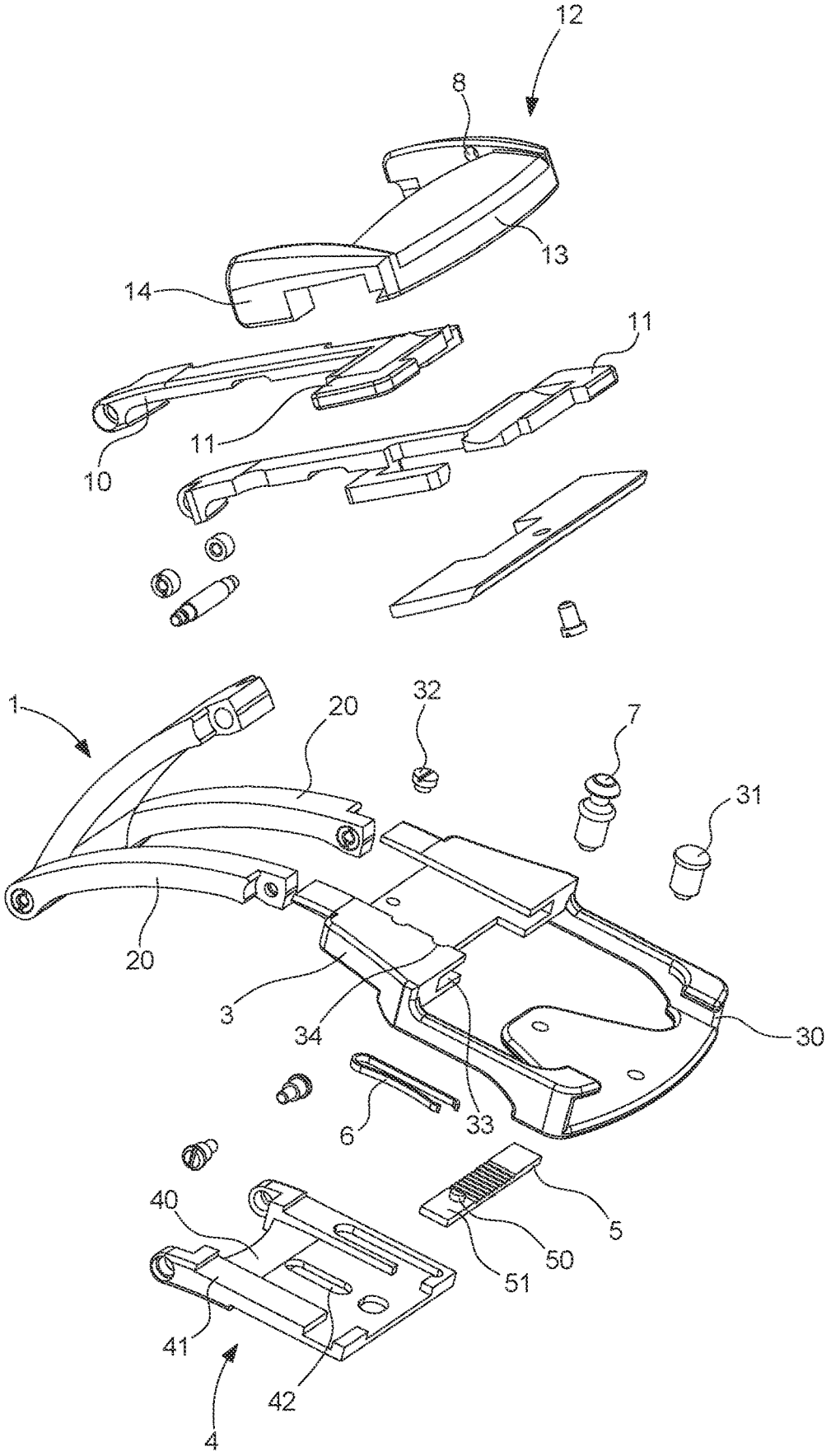
FIG. 3 shows an exploded view of a clasp in accordance with the invention.

As can be seen in FIG. 3, the carriage 4 comprises an L-shaped recess to receive the push-piece 5 and the leaf spring 6, the foot of the L receiving the leaf spring, and the body of the L receiving and guiding the push-piece 5 which projects slightly from the recess.

The carriage 4 comprises means for limiting its stroke relative to the loop 3, these stroke limiting means being in the form of a pin 32 integral with the loop 3 and which is arranged to cooperate with an oblong hole 42 of the carriage 4. Such an arrangement allows both to define the extreme positions of the carriage 4 relative to the loop 3, and to prevent the carriage 4 from becoming dislodged from the grooves 33. So as to be able to easily disassemble the carriage 4 from the loop 3, the pin 32 is screwed onto the loop 3.

Thus, when the wearer wishes to change the length of the wristlet, the wearer can modify the position of the carriage 4 by pressing on the push-piece 5 to dislodge the lug 50 from the notch 34 formed in one of the guide grooves 33, then slides the carriage 4 or the loop 3 towards a second position where the notch 34 is facing the lug 50. Once the position has been chosen, the wearer releases the push-piece 5 and the position is locked when the lug 50 is housed in the second notch.

Moreover, conventional locking means are provided to maintain the closed state of the clasp. To this end, a conventional locking mechanism is arranged to hold the first blade 2 hooked on the second blade 1 when no pressure is exerted simultaneously on the push-pieces formed by the extensions 11. The extensions 11 each have fixed hooks configured to cooperate respectively with the first stud 7 disposed on the loop 3.

When the extensions 11 are operated, the hooks move away from each other to switch the clasp into its open state.

Patent application EP 09131060 A1 describes in detail a clasp of this type and the person skilled in the art can refer to it if necessary.

The clasp 100 is shown in its long configuration in FIG. 2*a*. If the carriage is moved towards the second free notch, the wristlet (not shown) is then elongated and occupies the position of FIG. 3*a*.

It emerges from this presentation that the clasp according to the present invention comprises a movable element capable of being moved to adjust the useful length of the wristlet. The construction and handling of this clasp are simple and allow the user to easily adjust the clasp when necessary.

The foregoing description sets out to describe a particular embodiment by way of non-limiting illustration and the invention is not limited to the implementation of certain particular features which have just been described, such as for example the shapes specifically illustrated and described for the blades or else their mode of cooperation allowing to ensure the locking of the clasp.

The person skilled in the art will not encounter any particular difficulty in adapting the content of the present disclosure to their own needs and implementing a clasp, in particular for a timepiece, without departing from the scope of the present invention. It will be noted, for example, that the adaptation of the present teaching for the construction of a folding buckle with a structure different from that illustrated and described will not pose any particular difficulty for the person skilled in the art.

The invention claimed is:

1. A wristlet clasp comprising:

first and second blades hinged relative to each other, by a first of their respective ends, between a closed wearing position and at least one open position, said first blade carrying a member for fastening a first wristlet strand at least one locking member for holding said first and second blades in the closed position;

a loop defining a passage for a second wristlet strand and including a stud configured to be inserted into an adapted hole in the second wristlet strand to define a point for anchoring the second wristlet strand to the clasp; and a carriage connecting the second end of the second blade to the loop, said carriage being arranged to slide in the loop and able to switch from a first indexed position to a second indexed position to define at least two predefined positions associated with a predefined useful length of the wristlet.

2. The clasp according to claim 1, wherein said loop comprises two guide grooves disposed opposite each other and wherein the carriage slides in the direction of the length of the clasp.

3. The clasp according to claim 2, wherein the loop comprises indexing means defining the first and second indexed positions.

4. The clasp according to claim 3, wherein the indexing means comprise at least two notches disposed on at least one of the guide grooves.

5. The clasp according to claim 3, wherein the loop comprises a control member arranged to allow the movement of the carriage from one position to another.

6. The clasp according to claim 5, wherein the control member is in the form of a push-piece arranged on the carriage, the push-piece comprising a lug arranged to cooperate with the indexing means.

7. The clasp according to claim 6, wherein the push-piece is arranged to translate in a direction perpendicular to the direction of the length of the clasp.

8. The clasp according to claim 6, further comprising return means arranged to maintain the control member under stress.

9. The clasp according to claim 1, wherein the carriage comprises means for limiting the stroke of the carriage.

10. The clasp according to claim 9, wherein the means for limiting the stroke of the carriage comprise a pin integral with the loop and arranged to cooperate with an oblong hole of the carriage.

11. The clasp according to claim 10, wherein the ends of the oblong hole define two indexed positions of the carriage.

12. A wristwatch including a wristlet provided with a clasp according to claim 1.

* * * * *